United States Patent [19]

Malish

[11] Patent Number: 5,050,262

[45] Date of Patent: Sep. 24, 1991

[54] FLOOR MAINTENANCE BRUSH OR THE LIKE

[76] Inventor: Terrance J. Malish, 2520 Red Fox Pass, Willoughby, Ohio 44094

[21] Appl. No.: 363,289

[22] Filed: Jun. 7, 1989

Related U.S. Application Data

[63] Continuation of Ser. No. 22,068, Mar. 5, 1987, abandoned.

[51] Int. Cl.[5] ..... A46B 9/06

[52] U.S. Cl. ..... 15/180; 15/159 A; 15/49.1; 15/50.1; 15/DIG. 6

[58] Field of Search ..... 15/DIG. 6, 180, 159 A, 15/DIG. 5, 182, 49.1, 50.1

[56] References Cited

U.S. PATENT DOCUMENTS

| | | | |
|---|---|---|---|
| 3,072,944 | 1/1963 | Clayton | 15/DIG. 6 |
| 3,186,019 | 6/1965 | Hattori | 15/DIG. 6 |
| 3,295,156 | 1/1967 | Brant | 15/DIG. 6 X |
| 3,381,326 | 5/1968 | Dolan | 15/180 |
| 3,526,919 | 9/1970 | Byers | 15/180 |
| 3,551,935 | 1/1971 | Gaudry | 15/180 |
| 3,943,594 | 3/1976 | Alvin | 15/180 |
| 4,114,225 | 9/1978 | Malish | 15/180 X |
| 4,305,234 | 12/1981 | Pichelman | 15/DIG. 6 X |
| 4,756,044 | 7/1988 | Clark | 15/182 |

FOREIGN PATENT DOCUMENTS

| | | | |
|---|---|---|---|
| 1572804 | 8/1980 | United Kingdom | 15/DIG. 6 |

*Primary Examiner*—Harvey C. Hornsby
*Assistant Examiner*—Mark Spisich
*Attorney, Agent, or Firm*—Watts, Hoffmann, Fisher & Heinke Co.

[57] ABSTRACT

A brush for attachment to a floor maintenance machine having a plurality of tuft units projecting outwardly with the tuft units being disposed in a predetermined array of angularly oriented rows, and with alternate tuft units having bristles made from a non-abrasive polymeric material a substantially non-absorbent and slightly abrasive material.

5 Claims, 3 Drawing Sheets

FLOOR MAINTENANCE BRUSH OR THE LIKE

This is a continuation of co-pending application Ser. No. 07/022,068 filed on 3/5/87, abandoned. TECHNICAL FIELD The present invention relates to floor cleaning equipment, and more particularly relates to a brush device adapted for detachable connection to a floor maintenance machine of the type utilized for cleaning, burnishing, buffing and polishing a work surface such as a floor or the like.

BACKGROUND ART

The present invention relates to floor maintenance machines and specifically to a new and novel construction of a brush device adapted for detachable connection to a floor maintenance machine of the type particularly suited for use in commercial, institutional and industrial floor maintenance applications such as cleaning, buffing, burnishing and polishing. For example, this type of machine is disclosed in Applicant's prior U.S. Pat. No. 4,391,548 entitled "Coupling Device for Floor Maintenance Machines". In such machines a series of cleaning pads are typically utilized having various abrasive characteristics that are rotated upon actuation of the machine to perform various maintenance operations including buffing, burnishing, spray-buffing, polishing, and the like. Such pad-type cleaning equipment is also disclosed in U.S. Pat. No. 4,293,973 wherein the cleaning pad is detachably mounted on the pad holder via a series of polymeric (plastic) bristles. Though satisfactory for many applications such pad-type cleaning systems are not entirely satisfactory in all respects. For example, after a period of time the pads utilized in such systems tend to lose their abrasive characteristics and tend to wear particularly after long term work applications. Accordingly, as the pads lose their abrasive quality and experience a general wearing tendency they are rendered unsuitable for their intended applications. In addition, it has been recognized that such pads are not especially convenient to use and are oftentimes difficult to center and maintain in proper functional position during relatively high-speed operations on irregular or non-smooth surfaces. Further, such pads can be said to be somewhat difficult to clean and maintain and are relatively time consuming and very expensive to replace.

Accordingly, because of the problems attendant with pad-type systems various types of brushes have been used with floor cleaning equipment, such as disclosed in U.S. Pat. No. 4,305,234. However, such brush designs have not been found to be entirely satisfactory for buffing, burnishing and polishing applications. It is recognized, therefore, that there is a need for a floor cleaning device that will not only allow for the easy maintenance of a work surface such as a floor or the like in the fashion of a buffing, burnishing and polishing pad but for a device that is easy to use, reliable in performance and relatively inexpensive to produce and maintain.

SUMMARY OF THE INVENTION

The present invention relates to a brush device of the type adapted to be detachably coupled to a high-speed (e.g., 1000 to 3000 RPM) floor maintenance machine that incorporates a unique array of bristles that synergistically cooperate to provide cleaning, buffing, burnishing and polishing functions. Accordingly, the brush device of the present invention can be utilized to maintain an old surface or apply and buff, burnish or polish a new surface. Specifically, the present invention provides a brush with a unique fill pattern and material that gives a uniform polish and high lustre finish. This design has been found to have applications excellent for uneven floors and for hard-to-buff surfaces.

Specifically, the present brush device of the present invention includes a generally circular shaped base member with a centrally located hole extending therethrough to provide attachment of the brush device to the floor maintenance machine. The brush device incorporates a plurality of tuft units projecting outwardly in a direction away from the base member and with the tuft units each comprising a plurality of bristles. The tuft units are disposed in a predetermined array of angularly oriented rows with each of the rows extending in an arcuate configuration in plan view and in a direction away from the rotational central axis of the base member. Each row of tuft units includes alternate tuft units having a different bristle composition. In such case, alternate tuft units in each row comprise a plurality of bristles made from a substantially non-absorbent and non-abrasive polymeric material and tuft units made from bristles of an absorbent and slightly abrasive material. In the invention, the preferred bristle materials are made from a polymeric (plastic) material and from a natural fiber material. Such preferred bristle materials include a polyester material and a vegetable fiber material.

Also, in the invention the tuft units in each row are disposed at a predetermined angle of inclination relative to the base member and extend radially inwardly in a direction toward the rotational central axis of the base member whereby the bristles of the respective tuft units tend to flare radially outwardly and upwardly into a generally perpendicular or upstanding orientation relative to the general plane of the base member due to the centrifugal forces developed upon rotation of the brush.

Also, in the invention, the terminal ends of the polymeric bristles are flagged (slit) so as to maximize the density and hence, the surface area for frictional contact with the work surface.

Other objects and advantages of the present invention will become apparent as the following description proceeds when taken in conjunction with the accompanying drawings and claims.

DESCRIPTION OF THE PREFERRED EMBODIMENTS

Figure 1:
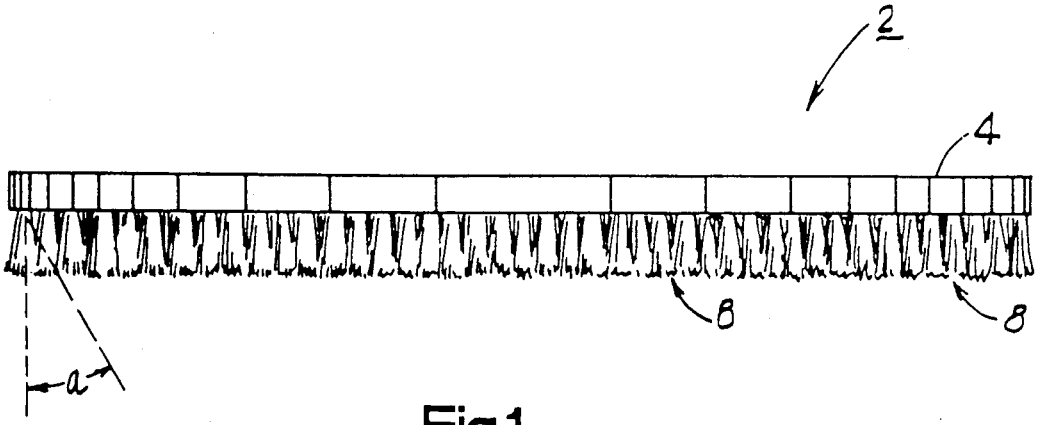
FIG. 1 is a side elevation view of the brush of the invention (removed from the floor maintenance machine) and incorporating the improved bristle pattern of the present invention.
Figure 2:
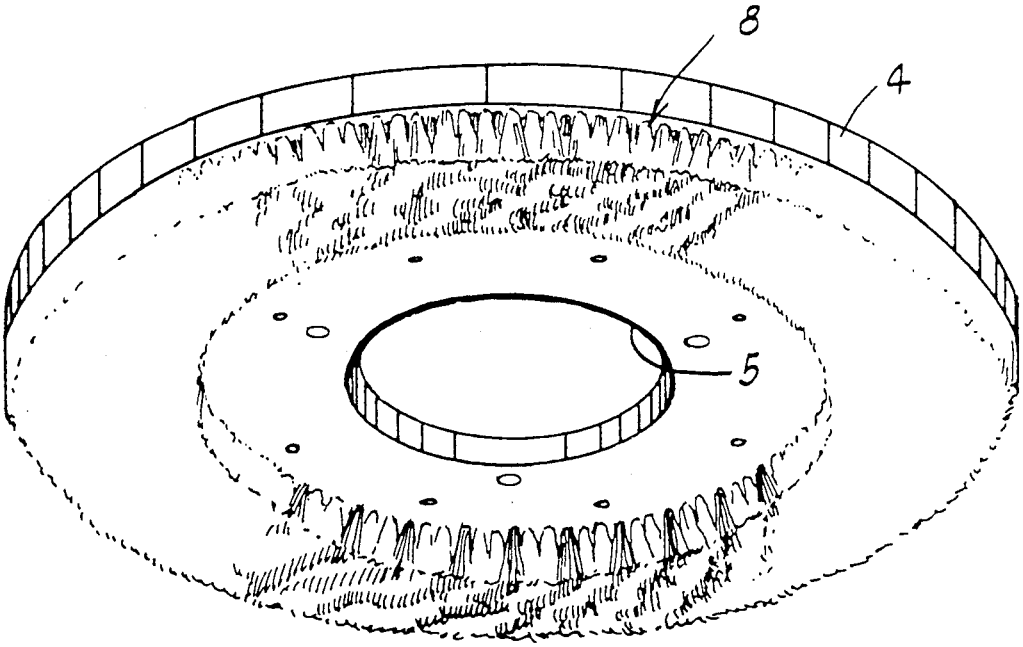
FIG. 2 is a generally perspective view looking at the underside of the brush device illustrated in FIG. 1, and illustrating the particular array of tuft units disposed in accordance with the present invention; and, FIG. 3 is an elevation view looking at the bottom side of the brush illustrated in FIG. 1, and more particularly illustrating the hole pattern provided in the base member for mounting the tuft units in arcuate rows that extend outwardly at a predetermined angle or radius relative to the rotational central axis of the base member.

Referring again to the drawings and in particular to FIG. 1 thereof, there is illustrated the brush device, designated generally at 2, of the type that can be employed in a high speed floor maintenance machine. The brush device 2 includes a circular, generally flat base member, as at 4, that may be made of a suitable plastic or wood material. The base member 4 (FIG. 2) has an axial hole, as at 5, extending therethrough for detachably connecting the brush device to the drive shaft (not shown) of the maintenance machine.

Figure 3:
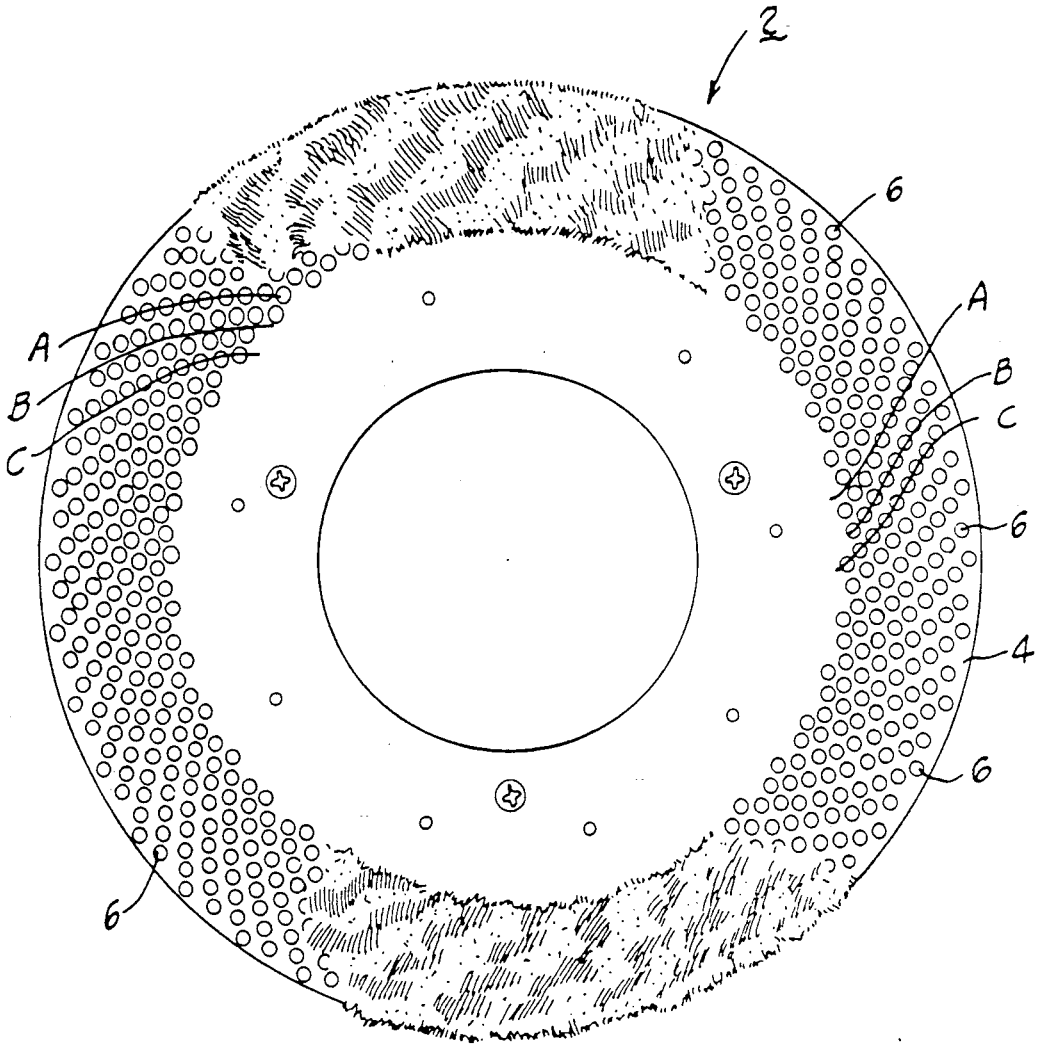

Now in accordance with the invention, the base member 4 is provided with a predetermined array of apertures or holes 6 having a diameter of ¼" disposed in arcuate rows, as at the reference characters A, B, C, of FIG. 3. The individual rows defined by the plurality of the apertures or holes 6 may vary in number dependent upon the particular number of tuft units 8 and hence, the bristle density required for particular application. Preferably, the individual rows are disposed in an arcuate pattern, in top plan view, such that the holes in adjacent rows are disposed about ⅛" apart and in a staggered relationship with respect to one another. However, it will be recognized that the holes may be disposed in a non-staggered pattern, or opposite one another. The respective rows of holes being of an arcuate pattern, they each define an "arc" with respect to the rotational central axis of the base member, as seen in FIG. 3.

In the invention, each of the tuft units 8 comprise a plurality of bristles that may be fixedly retained within the apertures or holes 6 by means of a staple or other suitable fastening means, as known in the art. Such staple lock retainer is illustrated, for example, in U.S. Pat. No. 4,293,973.

In accordance with the invention, the tuft units 8 in each row are each comprised of a plurality of the bristles of the same composition. Polishing bristles in every other tufts unit 10 comprises a plurality of polymeric (plastic) bristles made from a polyester. These polymeric bristles have non-absorbent and non-abrasive physical characteristics so as to impart a polished, high lustre to the work surface.

Figure 4:
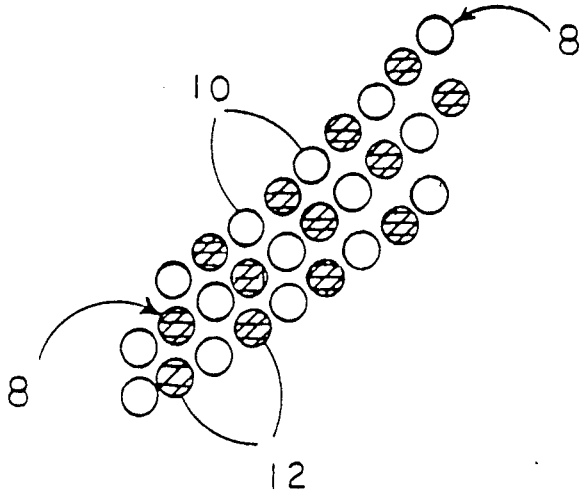
FIG. 4 is a schematic bottom plan view looking in the direction of FIG. 3 of three rows of tufts.

The alternate tuft units 12 in each row comprise bristles made from an absorbent material. This absorbent material is preferably comprised of a natural (vegetable) fiber material made from plants. This material is represented by cross-hatching in FIG. 4. A preferred material is tampico which is a processed vegetable fiber obtained from the Agava Lechvguilla plant in Northern Mexico. This tampico material can be utilized both in wet and dry applications. In a dry application, the material is used to buff and shine floor finishes. The fact that this tampico material varies in diameter from fine to coarse individual bristles in a given tuft, provides good absorptive qualities and provides a slightly abrasive action as compared to the non-abrasive polyester material. The purpose of the orientation of the tuft units is to provide a synergism that provides a brush capable of burnishing (i.e., removing streaks and scuff marks or the like) while simultaneously applying a buffing and/or to polishing a new finish across the work surface and without streaking. Accordingly and as aforementioned, it will be seen that the apertures or holes 6 and hence, the tuft units 8 in each row are preferably disposed in a staggered orientation with respect to one another due to the arcuate pattern of the individual rows. By this arrangement, there is provided an optimum uniform surface coverage (e.g. density) so as to maximize the cleaning area presented by the bristle ends. Preferably, the bristle ends are flagged by a suitable flagging operation. That is, the terminal free ends of the individual bristles are axially slit so as to maximize the frictional contact with the work surface. The flagging gives a distinct burnishing action rather than a mechanical abrasive action and hence, provides a pad-like polished surface without streaking.

The number of bristles per tuft unit will depend, for example, upon the diameter of the aperture or hole in the base member, the desired bristle density and the like for a particular application. The bristles are generally of the same length but may be of different lengths, if desired. The length of the bristles projecting beyond the outer face of the base member 4 could be of any length but one (1) inch projection is preferred. The individual bristles that are made from the polymeric (polyester) material preferably have a thickness of 0.005 to 0.040 inches. The polyester material has good flaggability, abrasion and moisture resistance with a tensile strength (PSI) between 40–50,000, tensile elongation PSI between 35–55, stiffness modules 450,000 (PSI-dry), 447,000 (PSI-wet), bulk density, (CU.IN./LB.) between 25–30, and specific gravity (g/cm$^3$) between 1.31–1.32.

Now in accordance with another aspect of the invention, the individual bristles rather than being disposed generally perpendicular to the general plane of the base member may be disposed at a predetermined acute angle (a), as illustrated in FIG. 1, extending inwardly in a direction toward the rotational central axis of the base member. Preferably, the bristles may be disposed at an inclined angle of between 1° and 30°, and with the preferred angle of inclination being 5° to 10°. By this arrangement, upon rotational movement of the base member, the centrifugal forces developed will tend to pull the bristles back into the perpendicular or upright position. Maintaining the bristles in this upright or vertical position maximizes the buffing, burnishing and polishing action on the work surface. This angle of inclination of individual bristles is best illustrated in dotted line in FIG. 1.

In the present invention while preferred embodiments have been disclosed, it will be understood that other various modifications and variations of the invention may be employed without departing from the scope of the invention covered in the appended claims.

I claim:

1. A brush of the type for attachment to a high-speed rotary floor maintenance machine of the type for cleaning, buffing, burnishing and polishing applications having a generally circular shaped base member with a centrally located hole extending therethrough to provide attachment of the brush to the floor maintenance machine, said brush comprising a plurality of tuft units projecting outwardly in a direction away from one side of said base member, said tuft units being disposed in singular rows, the rows each being laterally spaced from one another and extending radially outwardly in a direction away from the rotational axis of the base member, each of the rows defines a substantially similar arcuate configuration, in top plan view, in said radial direction, each of the rows including at least three individual tuft units, each tuft unit consisting essentially of a plurality of individual bristles of a single type of material wherein the tuft units in each of the rows alternate between a first tuft unit type having bristles made from a substantially non-absorbent and non-abrasive polymeric material and a second tuft unit type having bristles made from an absorbent and slightly abrasive material, such that adjacent tuft units in each row are of differing material and wherein the polymeric bristles are comprised of a polyester material and the absorbent bristles are made from a natural material.

2. A brush in accordance with claim 1, wherein said natural material is made from tampico.

3. A brush in accordance with claim 1, wherein the polymeric bristles are flagged at the terminal ends thereof.

4. A brush in accordance with claim 1, wherein the bristles in each of said tuft units are inclined angularly inwardly in a direction toward the rotational axis of said base member.

5. A brush in accordance with claim 1, wherein the tuft units in adjacent of said rows are oriented in a generally staggered relationship with respect to one another so as to provide a synergistic cleaning and buffing action on the work surface.

* * * * *